US012448097B2

(12) United States Patent
Allum et al.

(10) Patent No.: US 12,448,097 B2
(45) Date of Patent: Oct. 21, 2025

(54) BALANCED PISTON PUMP FOR SUBSEA USE

(71) Applicant: Y&R Allum Pty Ltd, Five Dock (AU)

(72) Inventors: Ronald Allum, Sydney (AU); Alan Lavery, Sydney (AU); Matthew Johnston, Sydney (AU); Rhys Horner, Sydney (AU)

(73) Assignee: Y&R Allum Pty Ltd, Lilyfield (AU)

( * ) Notice: Subject to any disclaimer, the term of this patent is extended or adjusted under 35 U.S.C. 154(b) by 445 days.

(21) Appl. No.: 18/025,410

(22) PCT Filed: Sep. 9, 2021

(86) PCT No.: PCT/AU2021/051045
§ 371 (c)(1),
(2) Date: Mar. 9, 2023

(87) PCT Pub. No.: WO2022/051810
PCT Pub. Date: Mar. 17, 2022

(65) Prior Publication Data

US 2024/0010314 A1 Jan. 11, 2024

(30) Foreign Application Priority Data

Sep. 9, 2020 (AU) ..... 2020903234

(51) Int. Cl.
*B63G 8/22* (2006.01)
*F04B 19/22* (2006.01)
*F04B 23/06* (2006.01)

(52) U.S. Cl.
CPC ..... *B63G 8/22* (2013.01); *F04B 19/22* (2013.01); *F04B 23/06* (2013.01)

(58) Field of Classification Search
CPC ..... F04B 19/22; F04B 23/06; F04B 1/124; F04B 23/12; F04B 25/02; F04B 53/02; F04B 53/14; F04B 53/144; F04B 5/00; F04B 1/306; F04B 23/02; F04B 5/02; B63G 8/22; B63G 8/24; B63G 8/001; B63G 2008/002
See application file for complete search history.

(56) References Cited

U.S. PATENT DOCUMENTS 7,033,143 B2 * 4/2006 Mead ..... F04B 49/20 417/490
7,921,795 B2 * 4/2011 Imlach ..... B63G 8/001 114/331

(Continued)

FOREIGN PATENT DOCUMENTS

GB 2375572 A * 11/2002 ..... F04B 23/021

*Primary Examiner* — Brian P Wolcott
(74) *Attorney, Agent, or Firm* — Darren Gardner

(57) ABSTRACT

A balanced piston pump (300) for use in subsea vehicles, for example in a variably buoyancy engine, includes an inlet (321), an outlet (325) and at least one fluid path between the inlet and the outlet. A piston arrangement in the fluid path includes a stepped piston (330) having a large end (333) and a small end (331). The step (336) of the piston cooperates with the body (310) of the pump to form a piston chamber (320). The ends (332, 334) of the piston are each exposed to ambient pressure. The force required to drive the pump is dependent on the difference in cross sectional areas of the ends of the pistons.

25 Claims, 17 Drawing Sheets

(56) References Cited

U.S. PATENT DOCUMENTS

| | | | | |
|---|---|---|---|---|
| 8,323,003 | B2 * | 12/2012 | Judge | F04B 9/1376 417/404 |
| 8,397,658 | B1 * | 3/2013 | Imlach | B63G 8/22 114/331 |
| 10,428,841 | B2 * | 10/2019 | Knoell | F15B 1/265 |
| 11,448,242 | B2 * | 9/2022 | Orth | F15B 15/18 |
| 2005/0123416 | A1 * | 6/2005 | Smith | F03C 1/007 417/390 |
| 2017/0350426 | A1 * | 12/2017 | Böhner | F15B 15/1409 |
| 2021/0190099 | A1 * | 6/2021 | Orth | E21B 33/063 |

* cited by examiner

BALANCED PISTON PUMP FOR SUBSEA USE

FIELD OF THE INVENTION

This application relates generally to underwater vehicles and in particular to pumps used in underwater vehicles, either manned or unmanned vehicles, particularly underwater gliders.

BACKGROUND OF THE INVENTION

Underwater vehicles, such as gliders, have the ability to travel through water to significant depths. The gliders are relatively quiet and can travel long distances on minimal fuel. These benefits allow gliders to be used for a range of purposes, including oceanographic surveys, military and defense applications, etc.

Pumps in underwater gliders have specific requirements due to their extreme operating depths. They are required to be efficient and reliable despite their harsh operating environment.

Therefore, what is required is an improved pump for use in subsea vehicles.

SUMMARY OF THE INVENTION

In one aspect of the disclosure, there is provided a pump including:

a pump body;
at least one inlet;
at least one outlet;
a fluid path between the at least one inlet and the at least one outlet;
at least one piston arrangement disposed in the fluid path and configured to pump fluid from the at least one inlet through the fluid path to the at least one outlet, the at least one piston arrangement including:
a piston chamber;
an inlet valve;
an outlet valve;
a piston disposed to move within the piston chamber, the piston including a first outer end surface at a first end of the piston and a second outer end surface at a second end of the piston;
a piston drive for driving the piston within the piston chamber, the piston drive operatively attached to the first end of the piston;
wherein at least one of the first outer end surface and the second outer end surface of the piston are exposed to an ambient pressure; and
wherein a surface area of the first outer end surface is smaller than a surface area of the second outer end surface such that an ambient pressure force on the second end is greater than an ambient pressure force on the first end.

In one aspect of the disclosure, there is provided a two-stage pumping system for use in a deepsea vessel, the two stage pumping system including:

a pressure vessel;
a main pump disposed to pump fluid from within the pressure vessel, the main pump including:
a pump body;
at least one inlet;
at least one outlet;
a fluid path between the at least one inlet and the at least one outlet;

at least one piston arrangement disposed in the fluid path and configured to pump fluid from the at least one inlet through the fluid path to the at least one outlet, the at least one piston arrangement including:
a piston chamber;
an inlet valve; and an outlet valve;
a piston disposed to move within the piston chamber, the piston including a first outer end surface at a first end of the piston and a second outer end surface at a second end of the piston;
a piston drive for driving the piston within the piston chamber, the piston drive operatively attached to the first end of the piston;
wherein at least one of the first outer end surface and the second outer end surface of the piston are exposed to an ambient pressure; and
wherein a surface area of the first outer end surface is smaller than a surface area of the second outer end surface such that an ambient pressure force on the second end is greater than an ambient pressure force on the first end.

In one aspect, there is provided a deepsea vehicle including a variable buoyancy engine, the variable buoyancy engine including:

a pressure vessel;
a main pump disposed to pump fluid from within the pressure vessel, the main pump including:
a pump body;
at least one inlet;
at least one outlet;
a fluid path between the at least one inlet and the at least one outlet;
at least one piston arrangement disposed in the fluid path and configured to pump fluid from the at least one inlet through the fluid path to the at least one outlet, the at least one piston arrangement including:
a piston chamber;
an inlet valve; and an outlet valve;
a piston disposed to move within the piston chamber, the piston including a first outer end surface at a first end of the piston and a second outer end surface at a second end of the piston;
a piston drive for driving the piston within the piston chamber, the piston drive operatively attached to the first end of the piston;
wherein at least one of the first outer end surface and the second outer end surface of the piston are exposed to an ambient pressure; and
wherein a surface area of the first outer end surface is smaller than a surface area of the second outer end surface such that an ambient pressure force on the second end is greater than an ambient pressure force on the first end.

BRIEF DESCRIPTION OF THE DRAWINGS

Reference will now be made, by way of example only, to specific embodiments and to the accompanying drawings in which.

DETAILED DESCRIPTION OF THE INVENTION

Submersible vehicles often utilize a variable buoyancy engine to generate forward momentum, allowing the vehicle to operate for extended periods independently of a surface vehicle. In a variable buoyancy engine, a vehicles buoyancy can be changed. The buoyancy may be changed absolutely, by pumping water, e.g. sea water, in and out of a pressure vessel within the vehicle to outside the vehicle in what is considered an open-loop system. Alternatively, the buoyancy distribution within the vehicle may be changed by pumping fluid from the pressure vessel to different areas of the vehicle or by changing the volume of the fluid to affect the density/buoyancy within the vehicle. In this closed-loop system, the fluid may be fresh water, oil or other type of fluid and is pumped into a flexible reservoir that is acted on by ambient pressure.

As the inside of the pressure vessel may be close to a vacuum, an internally mounted pump may be mounted inside the pressure vessel to act as a prime pump for an externally mounted main pump, thus providing a two-stage system. The prime pump may be any simple type of pump, such as vane type pump, impeller pump, piston pump, etc.

Figure 1:
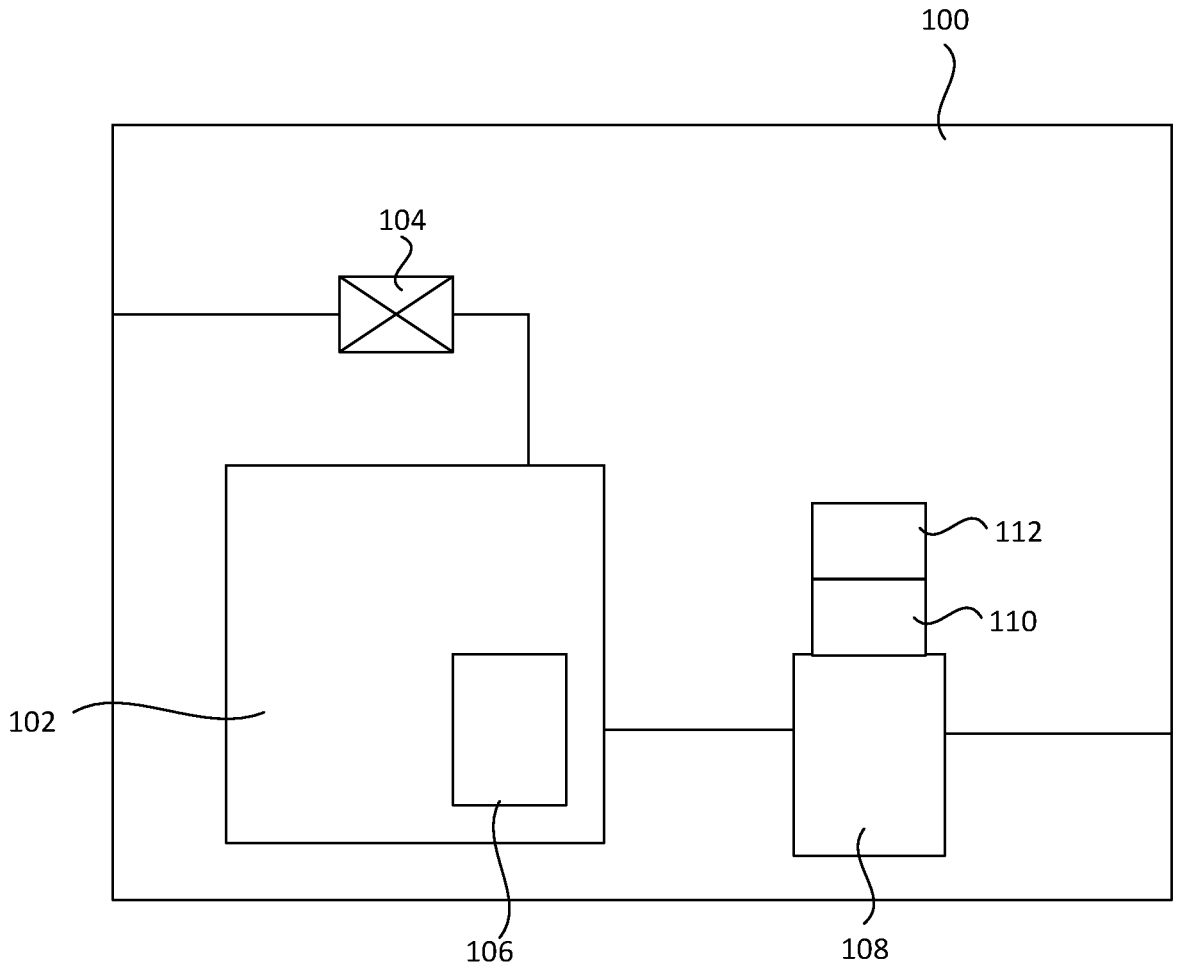
FIG. 1 schematically depicts an underwater vehicle with an open loop two-stage pumping system.

FIG. 1 shows a schematic of an embodiment of an open loop system. An underwater vehicle 100 has an internal pressure vessel 102. In an open loop system, an inlet valve 104, such as a solenoid valve, may control the flow of external seawater into the pressure vessel. To evacuate the pressure vessel 102, a two-stage pump may be used. A main pump 108 may pump water from the pressure vessel 102 to outside of the vehicle 100. A primary pump 106 located in the pressure vessel 102 may be used to ensure sufficient pressure in the lines to supply the main pump 108. The main pump may be operated by a motor 110, such as fluid-filled brushless DC motor. Batteries 112 may provide power to the motor 110.

Figure 2:
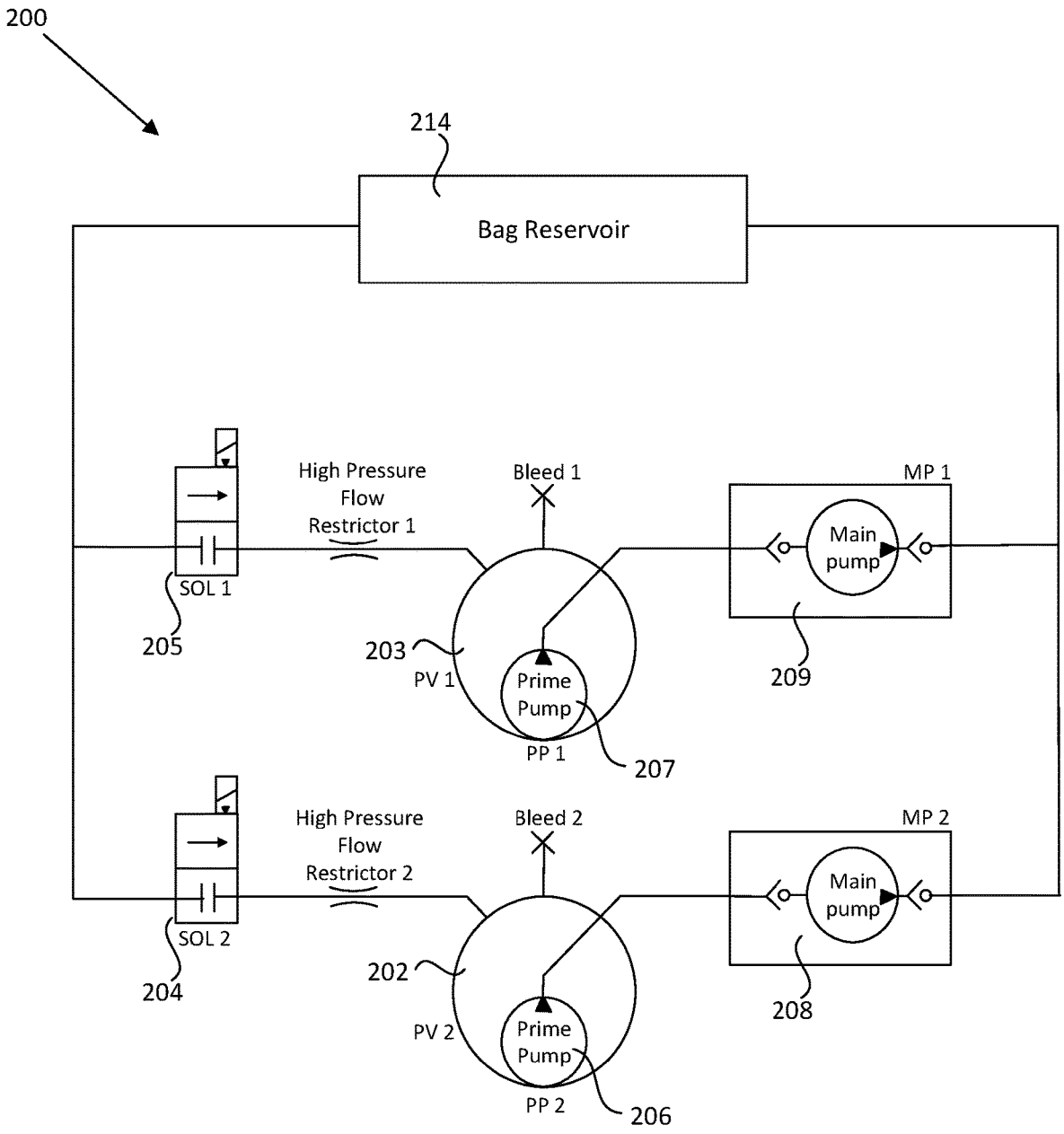
FIG. 2 schematically depicts a dual closed loop two stage pumping system for an underwater vehicle.

FIG. 2 shows a schematic of an embodiment of a closed loop system. The vehicle 200 contains dual pressure vessels 202, 203, primary pump 206, 207 in each pressure vessel and main pumps 208, 209 coupled to each of the primary pumps. However, instead of pumping fluid from the exterior of the vehicle, the pressure vessels 202, 203 are filled, via inlet solenoids 204, 205, from an internal flexible reservoir 214, such as a bag, that is acted on by external ambient pressure. The main pumps 208, 209 pump fluid from their respective pressure vessel 202, 203 back into the reservoir 214 against the ambient pressure acting on the reservoir 214. As fluid is allowed in and out of the bag 214 and independently in and out of the pressure vessels, the displacement between the pressure vessels and between the pressure vessels and the bag is altered, thereby affecting the buoyancy of the underwater vehicle.

FIGS. 1 and 2 show two-stage pump systems where the primary pump pressurizes fluid from the pressure vessel for supply to the main pump. In alternative arrangements, the primary pump may be removed if sufficient pressure is available from the pressure vessel to operate the main pump. For example, the pressure vessel may be partially charged by pumping fluid into the pressure vessel rather than allowing the pressure vessel to fill by free flow due to ambient pressure.

Three piston axial driven pumps are known for use as the main pump. However, such pumps are not generally designed to operate at the high ambient pressures (outside of the pressure vessel) that are encountered at ocean depths. The pump is required to expel fluid either externally or into a reservoir against the pressure of the ambient environment.

Figure 3:
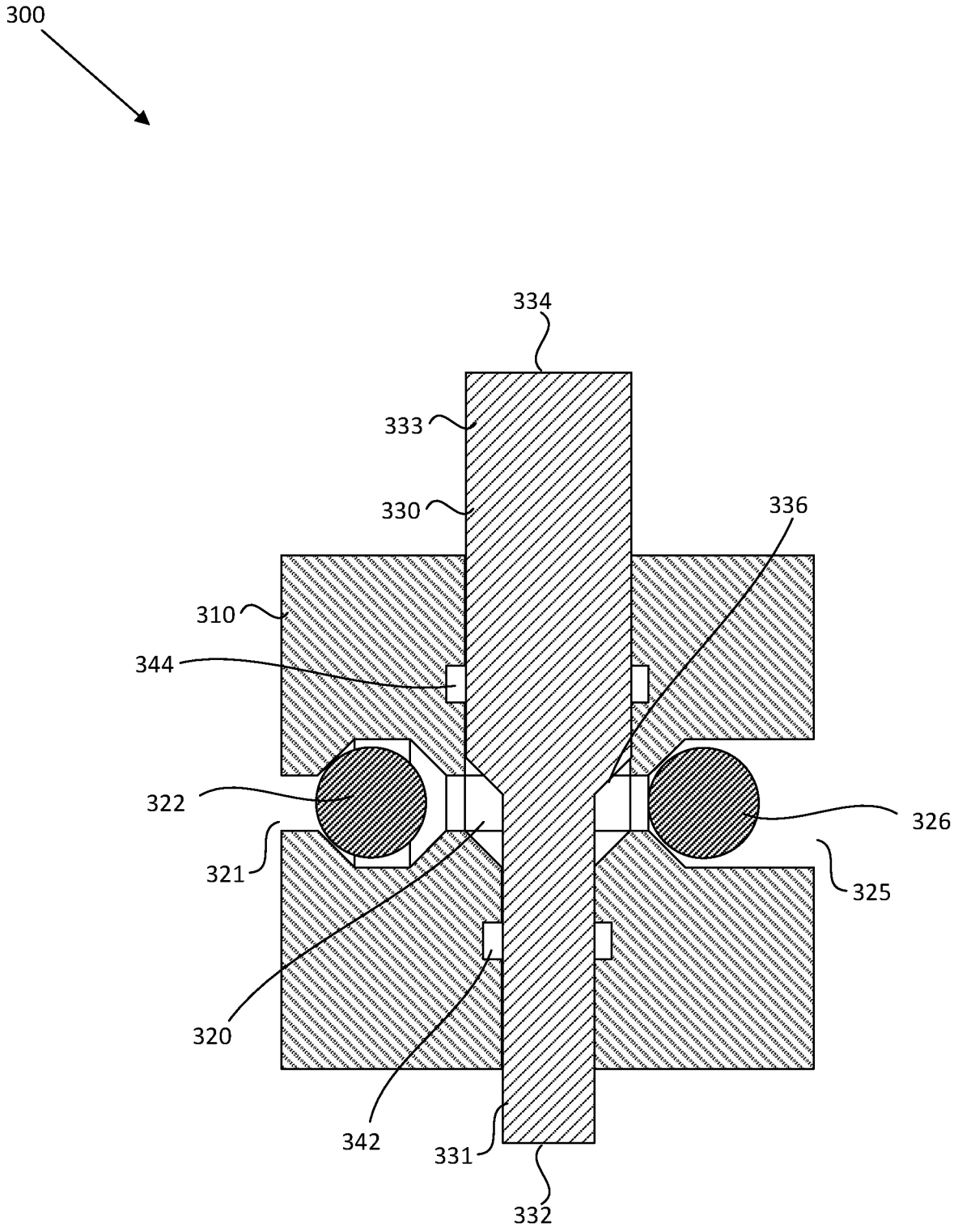
FIG. 3 schematically depicts a balanced piston pump for use as a main pump on an underwater vehicle.

To combat the high ambient pressures encountered at operating depths of a sub sea vessel, a main pump in accordance with an embodiment of the invention and referred to herein as a balanced piston pump may be provided. FIG. 3 shows a schematic of a balanced piston pump in accordance with an embodiment of the invention. The pump 300 of FIG. 3 includes a body 310 that defines a piston chamber 320. A stepped piston 330 is disposed for reciprocal movement within the piston chamber 320.

The piston chamber 320 is substantially toroidal and has an inlet 321 with an inlet check valve 322 and an outlet 325 with an outlet check valve 326. The piston chamber 320 receives fluid via the inlet 321 from the pressure vessel, initially pressurized by the primary pump (not shown in FIG. 3) (or partially charged pressure vessel) and expels fluid via the outlet 325.

The stepped piston 330 is substantially longitudinal and includes a first end 331 (small end) and a second end 333 (big end) at an opposite longitudinal end of the piston 330 to the first end 331. The first end 331 has a smaller diameter than the second end 333. A step 336 in the piston 330 changes the diameter of the piston 330 between the first end 331 and the second end 333. The step 336 is disposed within the piston chamber 320. The first end 331 has a first outer end surface 332 and the second end 333 has a second outer end surface 334. Each outer end surface 332, 334 is situated outside of the piston chamber 320 and is exposed to an ambient pressure. A piston drive or motor (not shown drives the reciprocating motion of the piston 330. The piston drive may be attached to the first end 331 of the piston.

Seals 342, 344 respectively seal the first end and second end of the piston 330 against the body 310 isolating the piston chamber 320 from ambient pressure.

Figure 4:
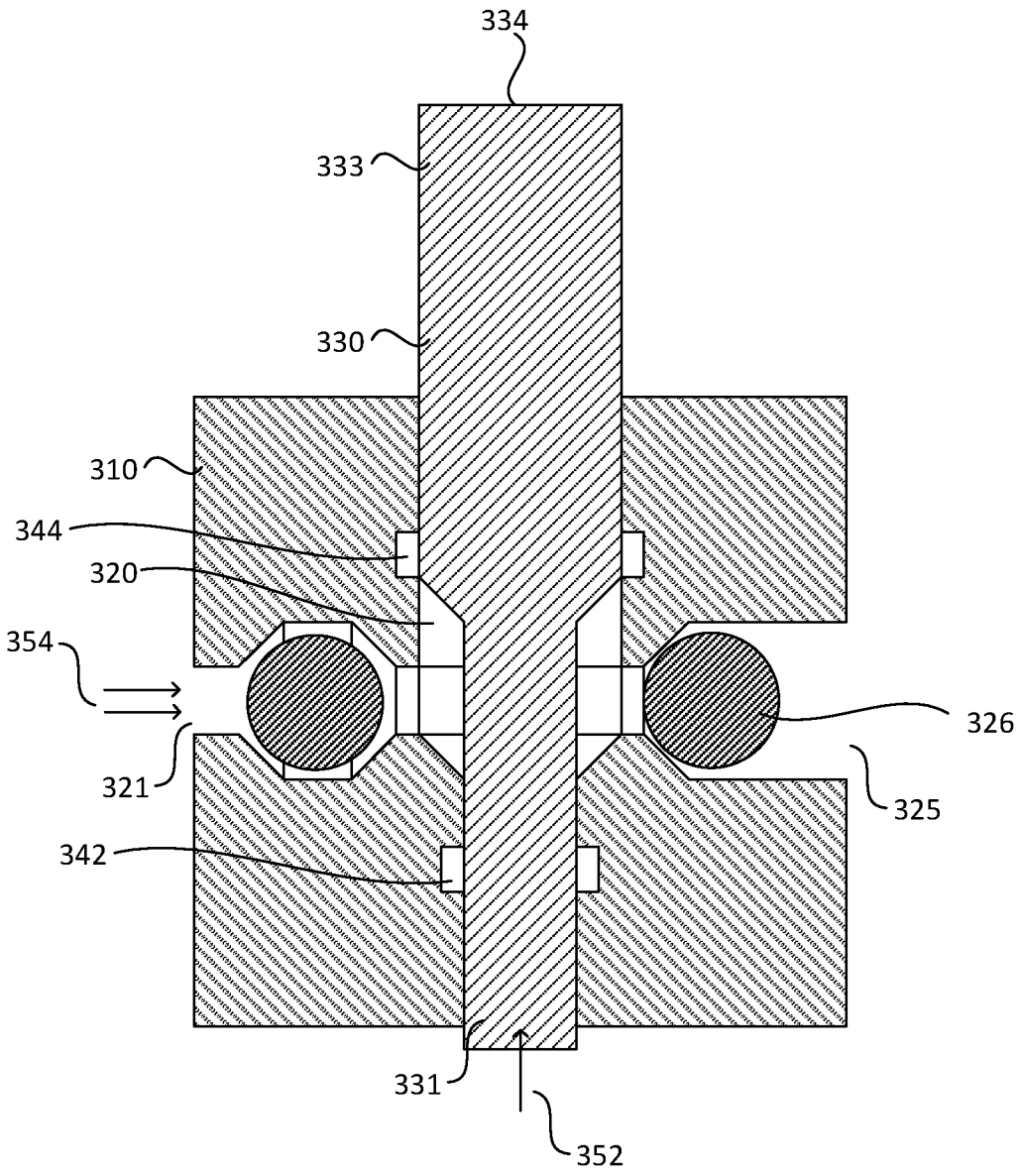
FIG. 4 schematically depicts an intake stage of operation of the pump of FIG. 3.
Figure 5:
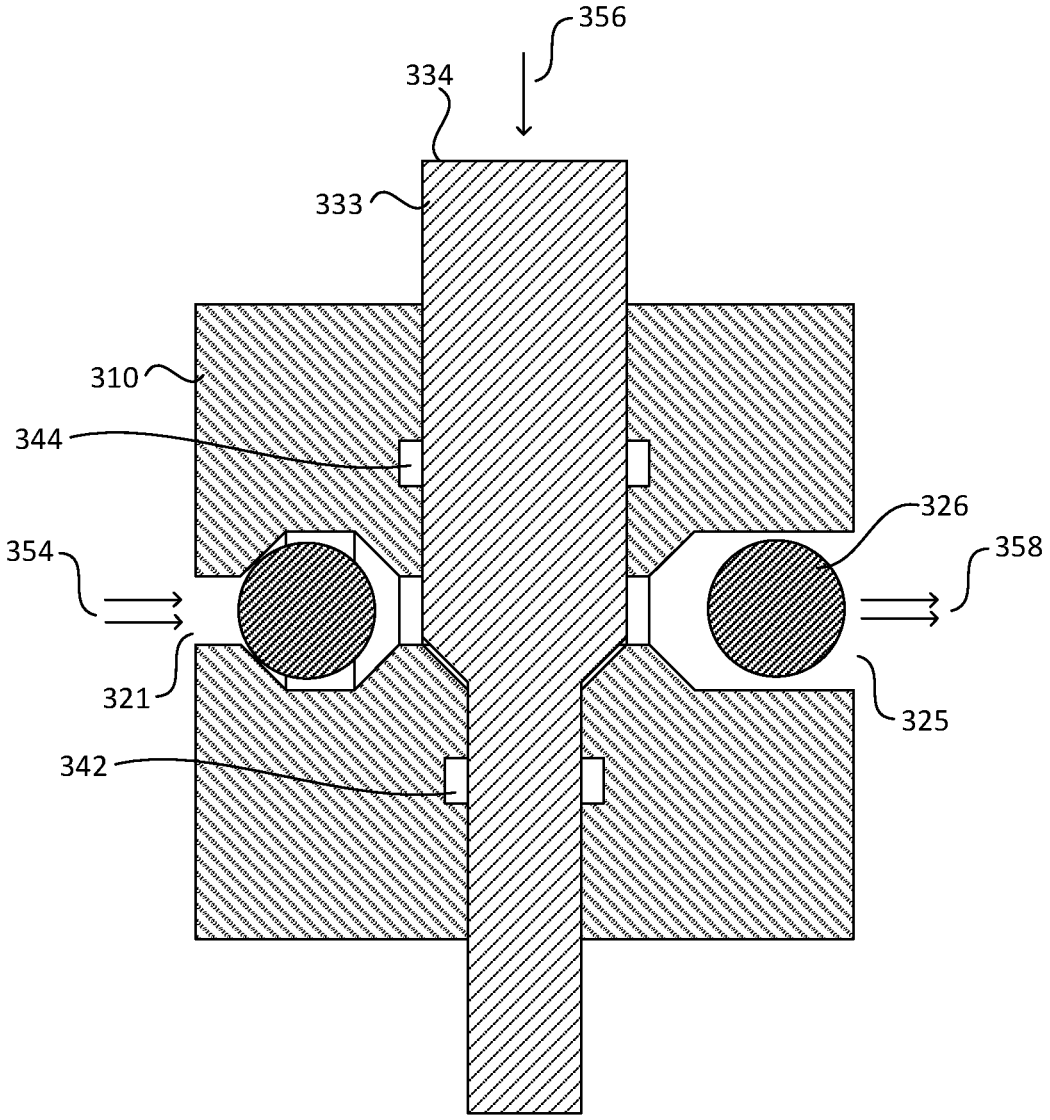
FIG. 5 schematically depicts a pressure stage of operation of the pump of FIG. 3.

In operation, the motor drives the first end 331 into the piston chamber 320 (FIG. 4) in the direction of arrow 352, thus driving the larger diameter portion of the piston 330 out of the piston chamber 320, and increasing the available volume of the piston chamber (intake stroke). Fluid is drawn into the piston chamber 320 via the inlet 321, as indicated by inlet arrows 354. In the return stroke (pressure stroke, FIG. 5), the larger end of the piston returns into the piston chamber (direction arrow 356), decreasing the volume of the piston chamber 320 and forcing the fluid through the outlet 325 as indicated by arrows 358.

A surface area of the first outer end surface 332 is smaller than a surface area of the second outer end surface 334 such that an ambient pressure force on the second end is greater than an ambient pressure force on the first end. Forces on the piston end surfaces 332, 334 created by the ambient pressure are largely negated allowing the pump to be designed to operate at any depth. Without being bound by theory, the force required on the first piston end 331 (the smaller end) by the piston drive to pump fluid, is equal to the difference in the cross-sectional areas of the smaller and larger end surfaces 332, 334 (in the embodiment shown, the cylinder chamber is toroidal) multiplied by the ambient pressure (ignoring friction, valve spring and other losses and assuming no input pressure is assisting).

In one embodiment, the piston end(s) are acted on by the pressure of the surrounding environment via oil filled compartment(s). This can be referred to as a "balance" operation. In one embodiment, one end of the piston is exposed to the ambient environment, but in an alternative embodiment, both ends of the piston are acted on by the ambient environment. The compartments may be isolated from each other or connected.

Figure 6:
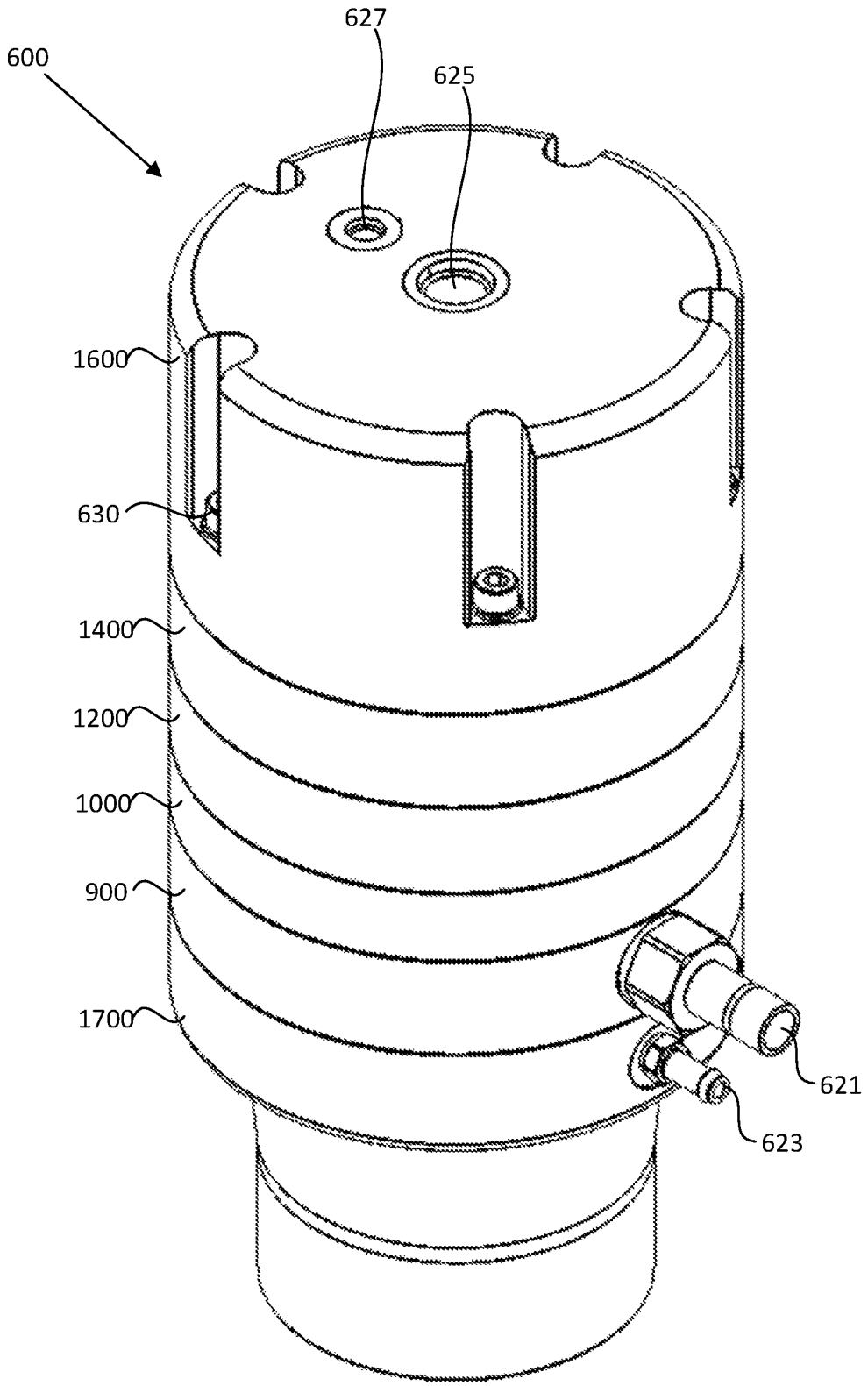
FIG. 6 is substantially a perspective view of a balanced piston pump in accordance with an embodiment of the invention.
Figure 7:
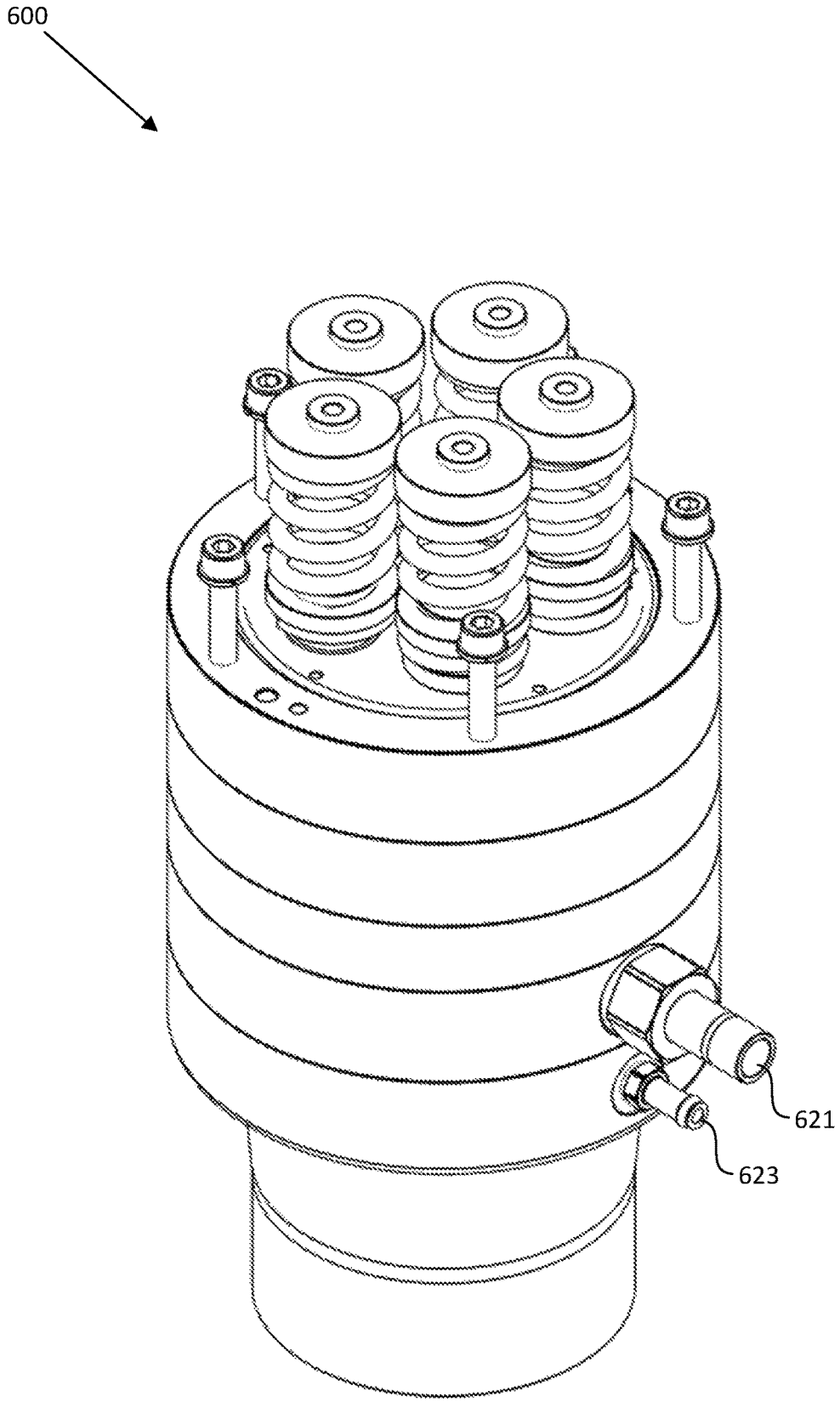
FIG. 7 shows the pump of FIG. 6 with the outer housing elements shown transparently.

FIG. 6 shows a perspective view of a balanced piston pump 600 in accordance with an embodiment of the invention. FIG. 7 shows the perspective of FIG. 6 with the outer body elements shown transparent to reveal the inner components of the pump. The pump 600 is a multi-piston pump having five pistons disposed around the circumference. A fluid inlet 621 provides fluid into the pump and is pumped out of an outlet on the top surface of the pump. An oil inlet 623 provides oil from an oil reservoir (not shown) into oil chambers within the pump and can be drained from outlet 627.

Figure 8:
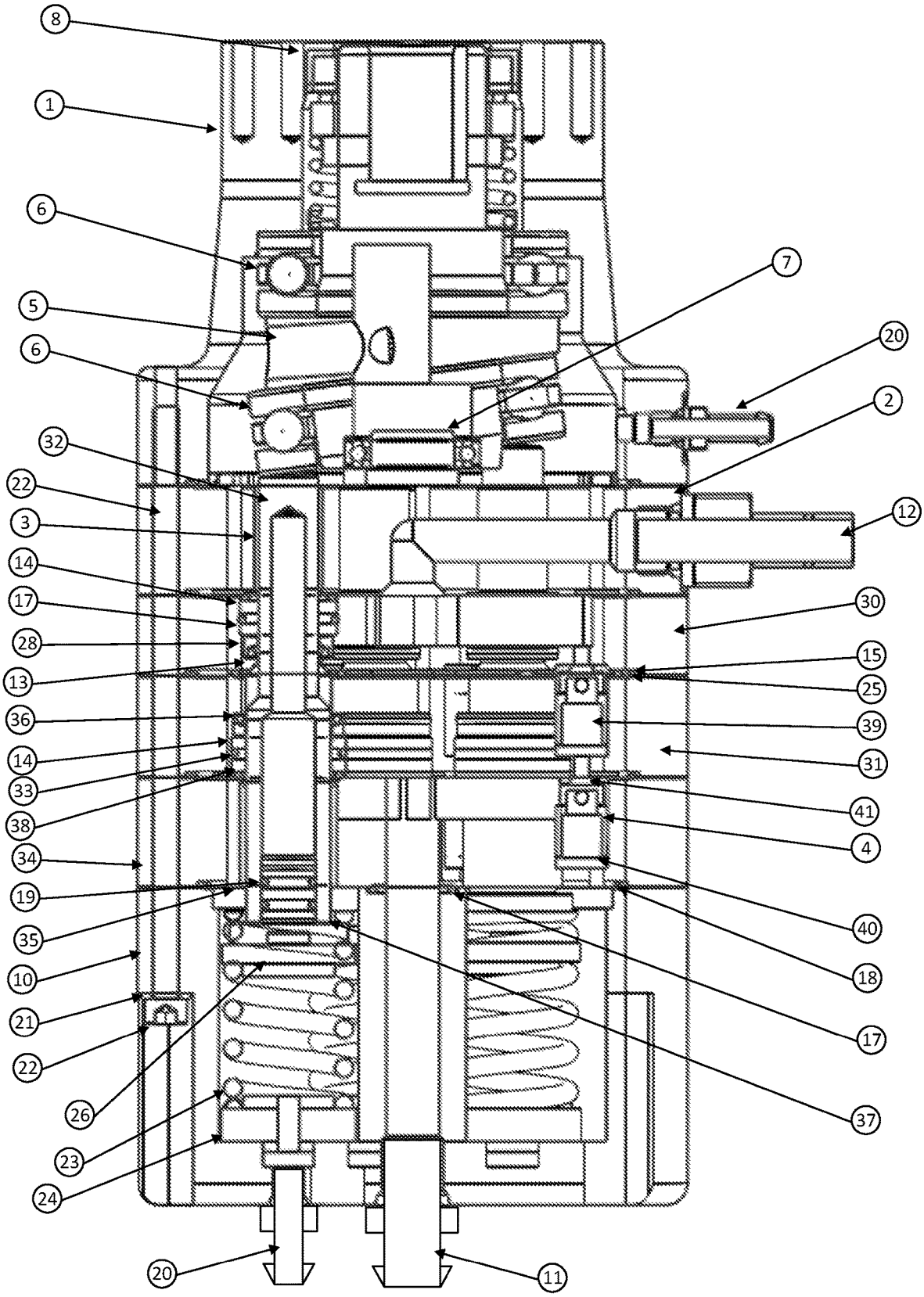
FIG. 8 shows a cross section of the pump of FIG. 6.

FIG. 8 shows a cross section of the pump 600 of FIG. 6 in an inverted view. The labelled components of the pump 600 are as follows:

| Item Number | Part description |
|---|---|
| 1 | Transmission Body |
| 2 | Small end guide plate |
| 3 | Bush |
| 4 | Valve poppet |
| 5 | Axle |
| 6 | Thrust ball bearings - single direction |
| 7 | Deep groove ball bearings |
| 8 | Mechanical seal - carbon - ceramic - nitrile |
| 10 | End PBOF volume |
| 11 | Hose barb |
| 12 | Tube adapter |
| 13 | Rod seal |
| 14 | O-ring - nitrile rubber |
| 15 | O-ring - nitrile rubber |
| 16 | O-ring - nitrile rubber |
| 17 | O-ring - nitrile rubber |
| 18 | O-ring - nitrile rubber |
| 19 | O-ring - nitrile rubber |
| 20 | Hose barb |
| 21 | Spring washer |
| 22 | Cylinder head cap screw |
| 23 | Valve spring |
| 24 | Top spring seat |
| 25 | O-ring - nitrile rubber |
| 26 | Piston spring seat reducer |
| 27 | Locator dowel pins |
| 28 | Small end retainer |
| 30 | Small end plate |
| 31 | Big end plate |
| 32 | Long piston |

-continued

| Item Number | Part description |
|---|---|
| 33 | Big end retainer |
| 34 | Big end guide plate |
| 35 | Piston spring seat |
| 36 | Rod seal |
| 37 | Bush |
| 38 | O-ring - nitrile rubber |
| 39 | Compression spring |
| 40 | Outlet poppet spring |
| 41 | O-ring - nitrile rubber |

The five piston pump 600 has a body made up of several circular plates joined together that internally define five individual fluid channels through the body from the unitary inlet 621 to the unitary outlet 625. Piston arrangements are disposed in each of the fluid channels. For the description to follow, reference will be made to the orientation of FIG. 6 where the outlet 625 and big end are shown at the top, and the small end, or drive end, are shown at the bottom. Terms of orientation are for illustrative purposes only and are not intended to limit the scope of the invention to these orientations.

Figure 9:
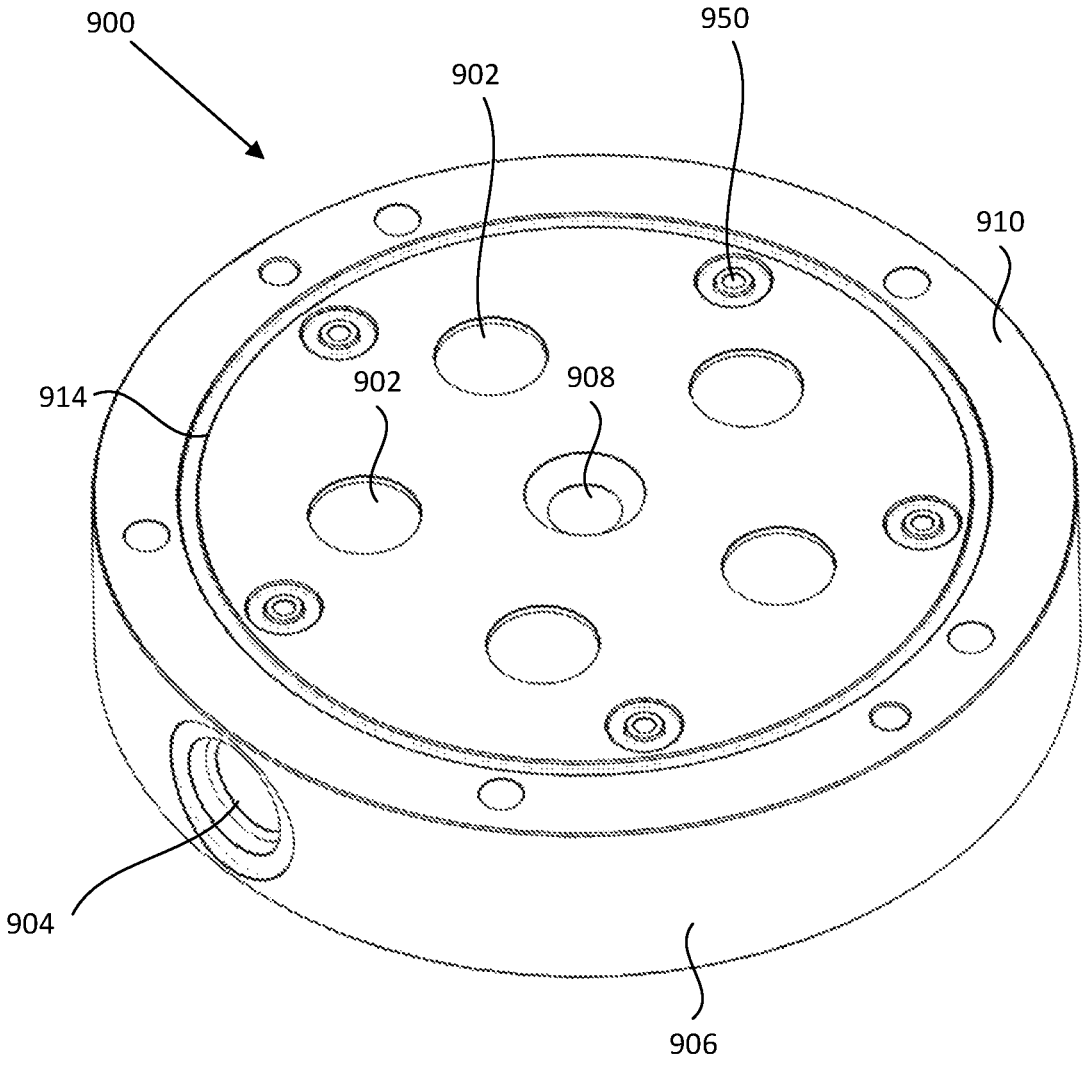
FIG. 9 shows an inlet plate.

FIG. 9 shows a top view of an inlet plate 900. The inlet plate has 5 radially dispersed piston guide holes 902 that extend longitudinally through the plate. The guide holes 902 are configured to accommodate the small end of the stepped piston. A radial bore 904 receives the inlet 621 and extends from the circumferential edge 906 of the plate to a central longitudinal bore 908 that extends down from the top surface 910 of the plate 900 to meet the radial bore 904. The longitudinal bore 908 is closed on the lower surface of the plate 900.

Figure 10:
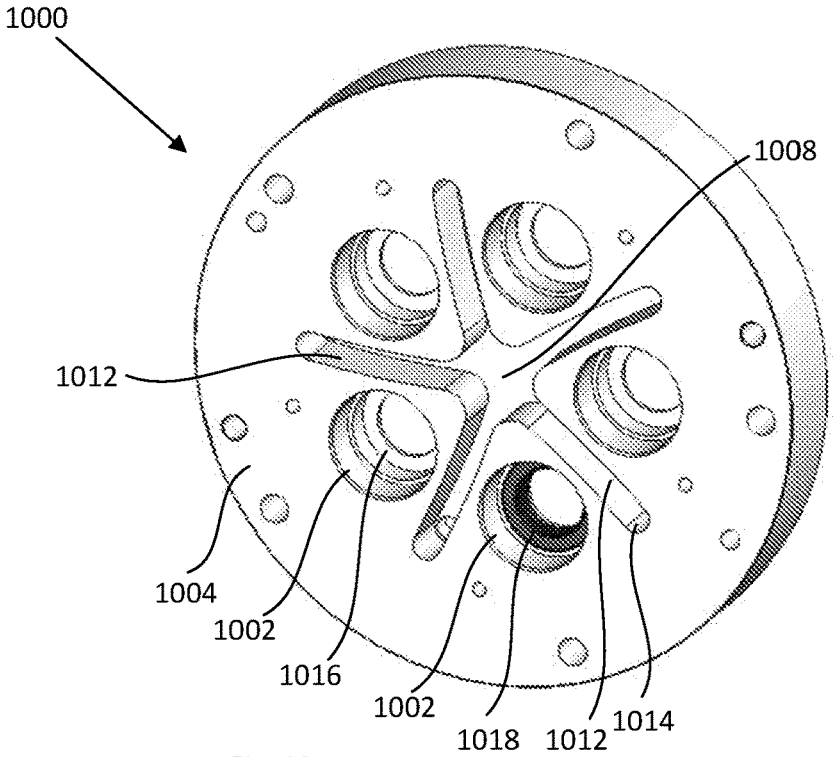
FIG. 10 shows a bottom view of a small end plate.

The top surface 910 of the inlet plate 900 abuts an underside surface of a small end plate 1000 (FIG. 10). The small end plate 1000 includes piston guides 1002 that extend longitudinally through the plate 1000 in alignment with the piston guides 902 of the inlet plate 900. The underside surface 1004 of the small end plate has a central longitudinal bore 1008 that extends part way into the plate but is closed on the top surface 1010. A series (five) of channels 1012 extend radially from the central bore 1008 to an outer channel end 1014. At each outer channel end 1014, there is a hole extending longitudinally through the plate 1000 to the top surface.

Figure 11:
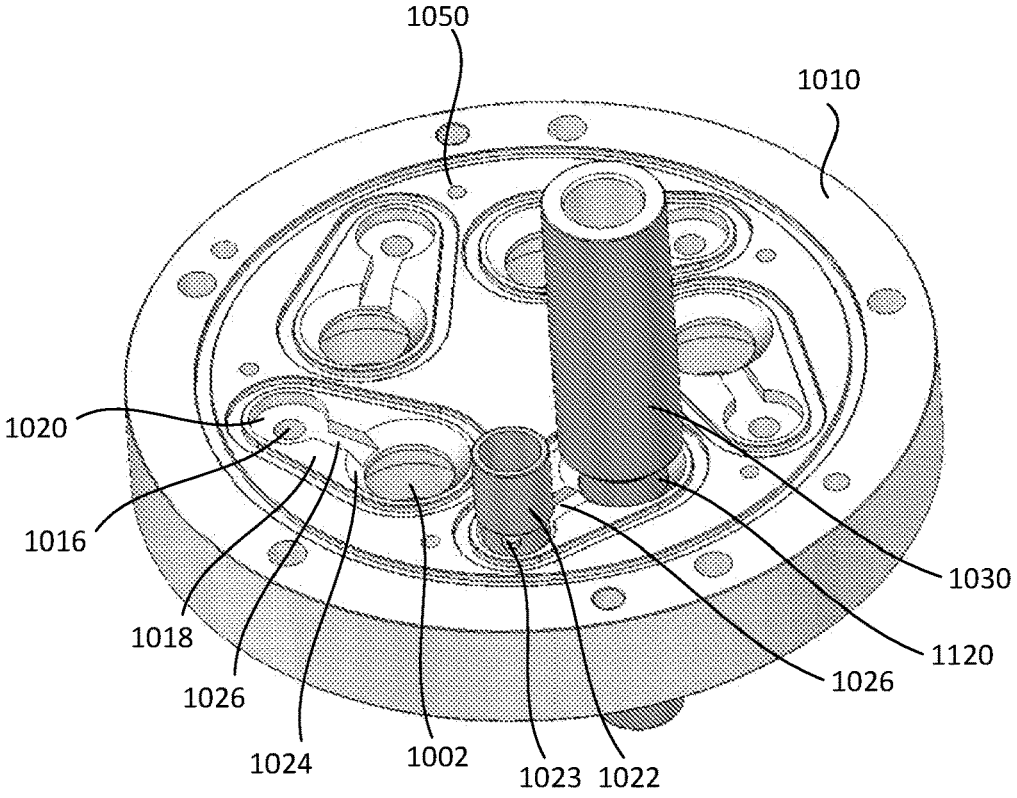
FIG. 11 shows a top view of the small end plate.

The top of the small end plate 1000 is shown in FIG. 11. Five recesses 1018 are distributed around the plate. Each recess 1018 includes an inlet poppet valve seat 1020. Within the poppet valve seat is the channel hole 1016 that extends through the plate in alignment with the outer channel ends 1014 of the channels 1012. The inlet poppet valve seat 1020 is configured to receive an end of an inlet poppet valve that seals the channel hole 1016. A single poppet valve 1022 is shown in FIG. 11, the remaining poppet valves are omitted for clarity in the drawing. The recess 1018 extends to the piston guide 1002. The piston guide is stepped 1024 to define a lower end of the piston chamber. The step 1024 matches the step of the piston 1030. The piston guide is configured to receive and seat the stepped portion of the piston. A single piston 1030 is shown adjacent the inlet poppet valve 1022. The remaining pistons are omitted for clarity in the drawing.

FIG. 10 shows that each piston guide 1002 is stepped 1016. The upper portion of the piston guide is sized to snugly fit the small end of the stepped piston. Below the step, the width of the piston guide increases. A sealing ring 1018 may be inserted into the piston guide 1002 from the lower surface and located at the step 1016 to seal the piston chamber above the sealing ring from ambient pressure below the sealing ring.

Above the piston seat 1024 is the piston chamber 1120 (described in more detail below). An inlet channel 1026 extends from the inlet poppet valve seat 1020 to the piston chamber 1120. When the piston is in a lower configuration fully seated by the piston seat 1024, the body of the piston 1030 seals against the inlet channel 1026 and prevents any fluid flow into the piston chamber 1120. At this stage the poppet valve is biased closed to seal the channel hole 1016. When the piston raises and moves away from the seat 1024, the inlet channel 1026 is open to the piston chamber. At this stage, the vacuum created in the piston chamber 1026 and the pressure of fluid from the inlet is sufficient to overcome the closing bias of the inlet poppet valve 1022. The poppet valve opens and fluid is able to flow through the inlet plate 900, into the channels 1012 of the small end plate, through the channel hole 1016 and inlet channel 1026 of the respective open piston and into the piston chamber 1120.

It can be seen in FIG. 11 that the poppet valve 1022 is open from the top and includes holes 1023 in the side of the body of the poppet valve 1022. At the top of the piston stroke when the piston chamber 1120 is full of fluid and the pressure is equalized to the inlet pressure, a spring or similar biasing mechanism disposed above the poppet valve may force the poppet valve to close, thereby sealing the channel hole 1016.

Figure 12:
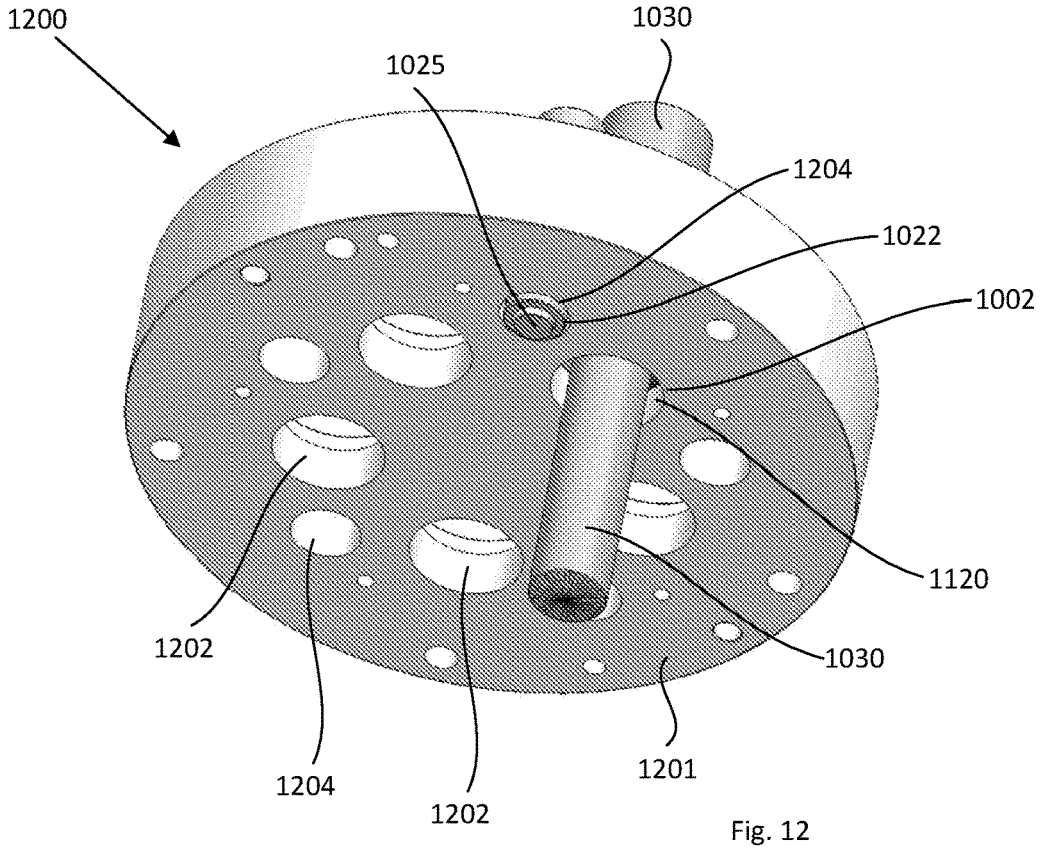
FIG. 12 shows a bottom view of a big end plate.

FIG. 12 shows an underside view of a big end plate 1200 that sits atop the small end plate 1000. The big end plate 1200 includes piston guides 1202 that extend longitudinally through the plate 1200 in alignment with the piston guides 1002 of the small end plate 1000. The guide holes 1202 are configured to accommodate the big end of the stepped piston. Within the lower surface 1201 of the big end plate 1200 are inlet poppet valve guides 1204 which align with the poppet valve seats 1020 on the small end plate 1000. FIG. 12 shows a single inlet poppet valve 1022 disposed within a poppet valve guide 1204. The remaining inlet poppet valves are omitted in the drawing for clarity.

The inlet poppet valve guides are of sufficient diameter to accommodate the width of the inlet poppet valves and with space between the inlet poppet valve and the valve guide. The valve guides terminate most of the way through the big end plate 1200. A smaller exit aperture extends to through from the valve guide to the top surface of the big end plate 1200. A spring or other biasing mechanism (39 in FIG. 8) is provided within the valve guide 1204 to bias the inlet poppet valve downwards against the inlet poppet valve seat 1020. The base 1025 of the inlet poppet valve is narrower than the main body of the poppet valve but is sufficient to seal the channel hole 1016. However, once the base is sealed against the channel hole 1016, fluid is able to flow around the inlet poppet valve and into the valve guide 1204. Thus, when the piston is on the return stroke, fluid is pushed by the piston 1030 from the piston chamber (shown as the toroidal space 1120 between the small end of the piston 1030 and the wall of the piston guide 1202) into the valve guide 1204 via the channel 1026 side holes 1023 of the poppet valve 1022.

Figure 13:
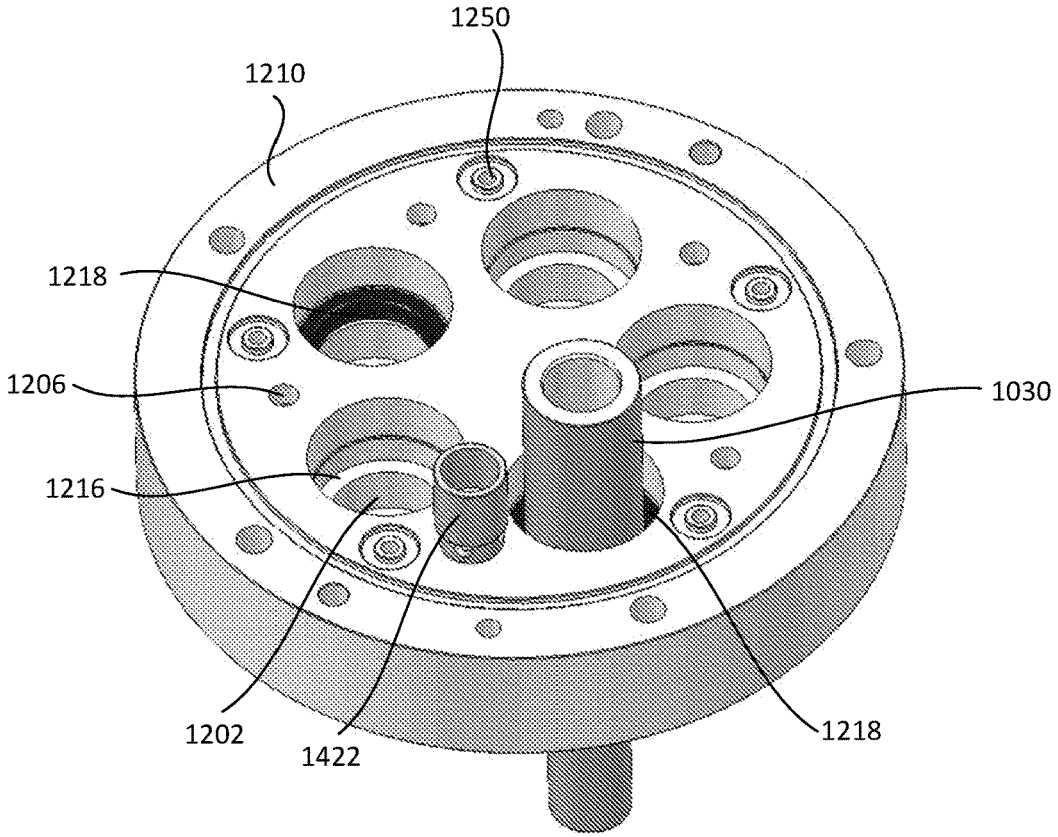
FIG. 13 shows a top view of the big end plate.

FIG. 13 shows the top 1210 of the big end plate 1200. Adjacent each piston guide 1202 is an exit aperture 1206 that aligns with an underlying inlet poppet valve guide 1204. The exit aperture 1206 is sealed by an outlet poppet valve 1422. A single outlet poppet valve 1422 is shown in FIG. 13. The remaining outlet poppet valves are omitted for clarity. FIG. 13 shows that each piston guide 1202 is stepped 1216. The lower portion of the piston guide is sized to snugly fit the large end of the stepped piston. Above the step, the width of the piston guide increases. A sealing ring 1218 may be located at the step 1216 to seal the piston chamber below the sealing ring from ambient pressure above the sealing ring.

Figure 14:
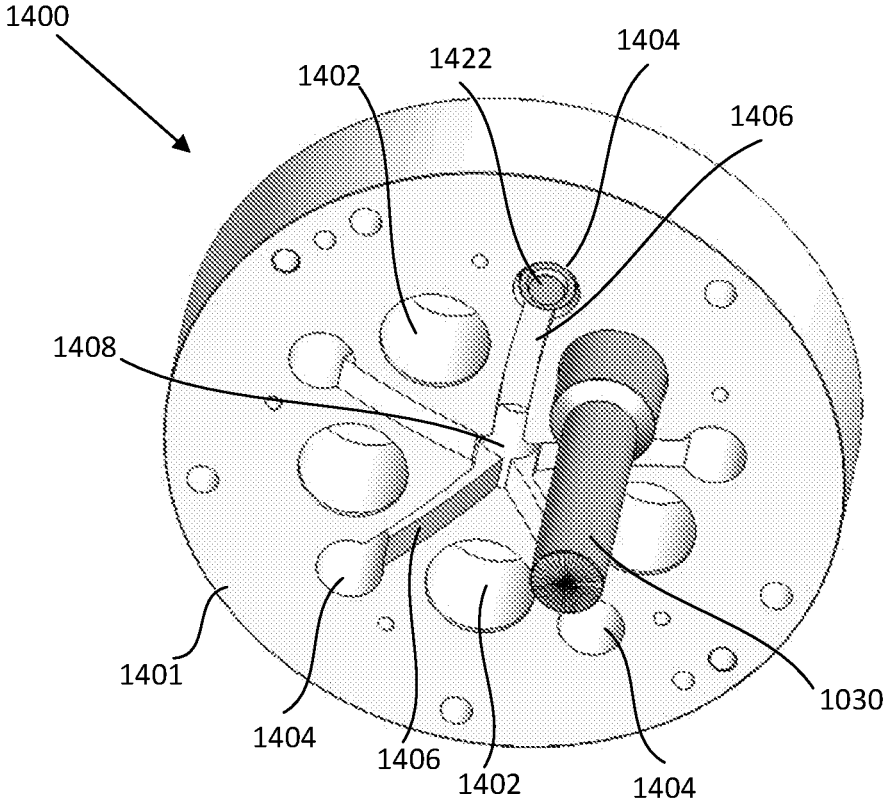
FIG. 14 shows a bottom view of an outlet plate.

FIG. 14 shows the underside surface 1401 of an outlet plate 1400. The outlet plate sits atop the big end plate 1200. The outlet plate 1400 includes piston guides 1402 that extend longitudinally through the plate 1200 in alignment with the piston guides 1202 of the big end plate 1200. The guide holes 1402 are configured to accommodate the big end of the stepped piston. Recessed within the surface 1401 are outlet poppet valve guides 1404 in alignment with the inlet poppet valve guides 1204 of the big end plate 1200. Extending from each outlet poppet valve guide 1404 are radial channels 1406 that extend to and meet at a central bore that passes axially through the outlet plate 1400. FIG. 14 shows a single outlet poppet valve 1422 disposed in the valve guide 1404. The remaining outlet poppet valves are omitted from the drawing for clarity.

Figure 15:
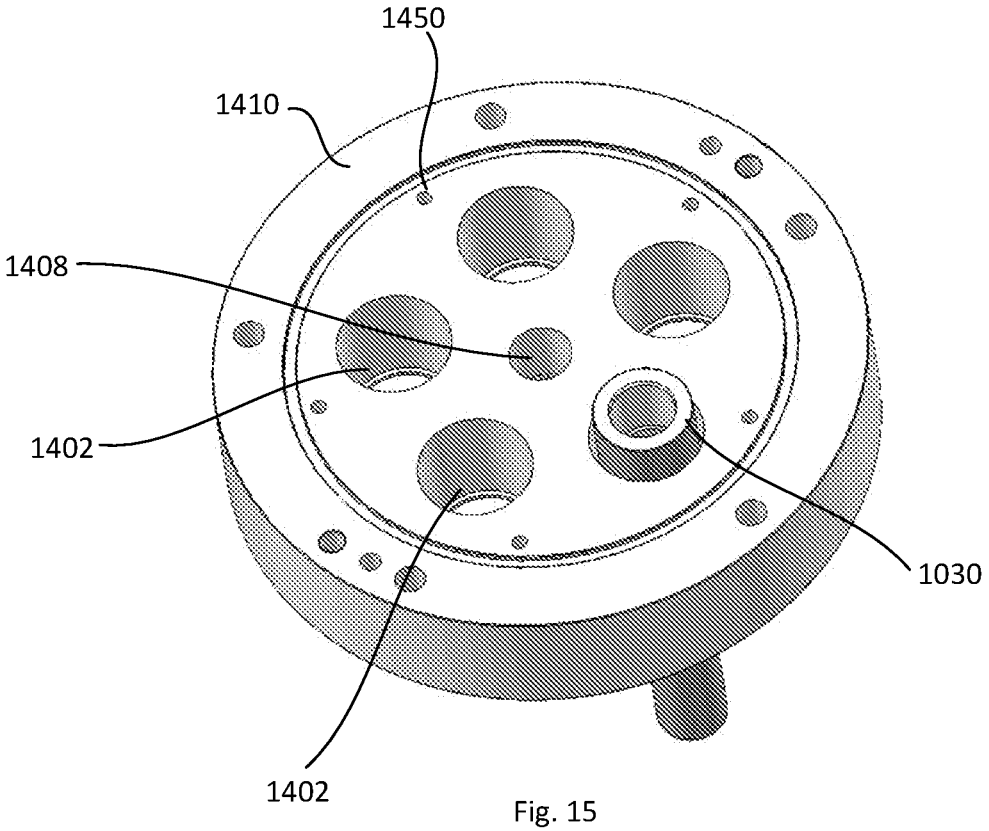
FIG. 15 shows a top view of the outlet plate.

FIG. 15 shows the top surface 1410 of the outlet plate 1400. The top surface 1410 shows the piston guides 1402 and a single piston 1030 extending above the outlet plate. The remaining pistons are omitted from the drawing for clarity. The central bore 1408 that communicates with the channels 1406 on the underside of the plate 1400 is shown passing through the thickness of the plate 1400.

Figure 16:
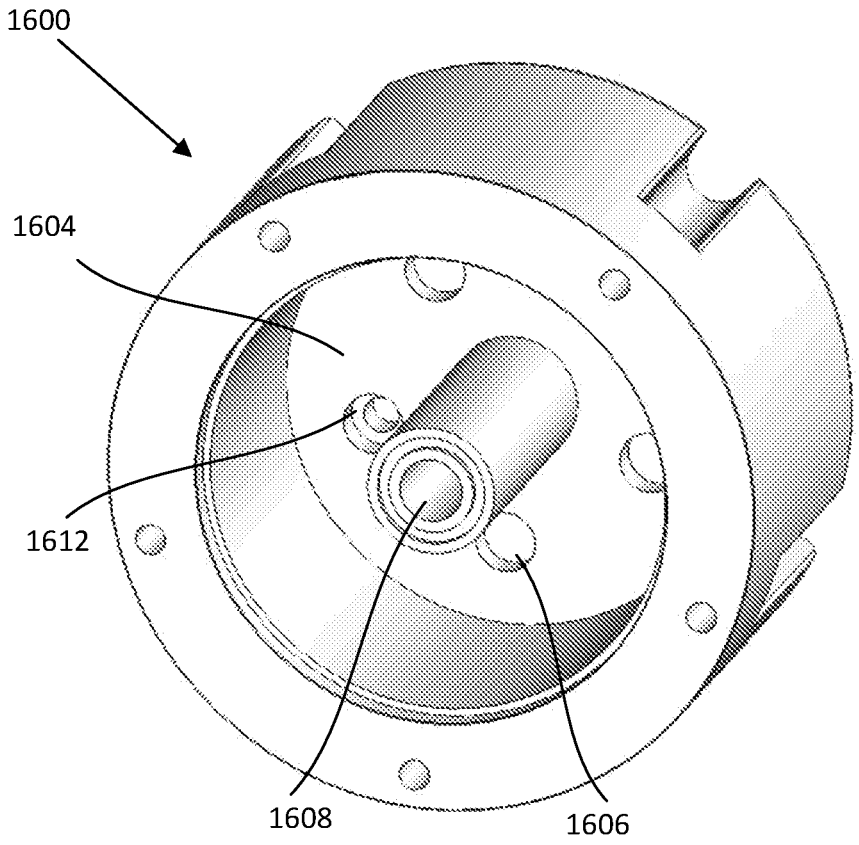
FIG. 16 shows an end cap.

FIG. 16 shows an end cap 1600 of the pump. The end cap has a central bore 1608 that leads to the outlet 625. The central bore aligns with the central bore 1408 of the outlet plate 1400. The end cap 1600 is generally hollow and together with the top surface 1410 of the outlet plate 1400 defines an ambient pressure volume 1604. The large ends of the pistons extend into the volume 1604. Valve springs (e.g. valve springs 23 in FIG. 8) can be seated in spring recesses 1606. One of the spring recesses 1612 can extend through the end cap to provide a connection to ambient pressure for the pressure volume 1604. In one embodiment, the aperture 1612 (shown on the outside of the end cap 1600 in FIG. 6 as oil outlet 627) can be used for filling or removing oil to the ambient pressure volume 1604.

As stated above, on the down stroke of the piston 1030, fluid is forced into the valve guides 1204 of the inlet poppet valves. As the piston force increases on the down stroke, the pressure on the outlet poppet valves 1422 sealing the exit apertures 1206 of the inlet poppet valve guides 1204 opens the outlet poppet valve and allows fluid to flow into the outlet poppet valve guide 1404, thence into channel 1406, through the axial bore 1408 of outlet plate 1400 and to the outlet 625 of the end cap 1600, thereby being expelled from the pump.

Figure 17:
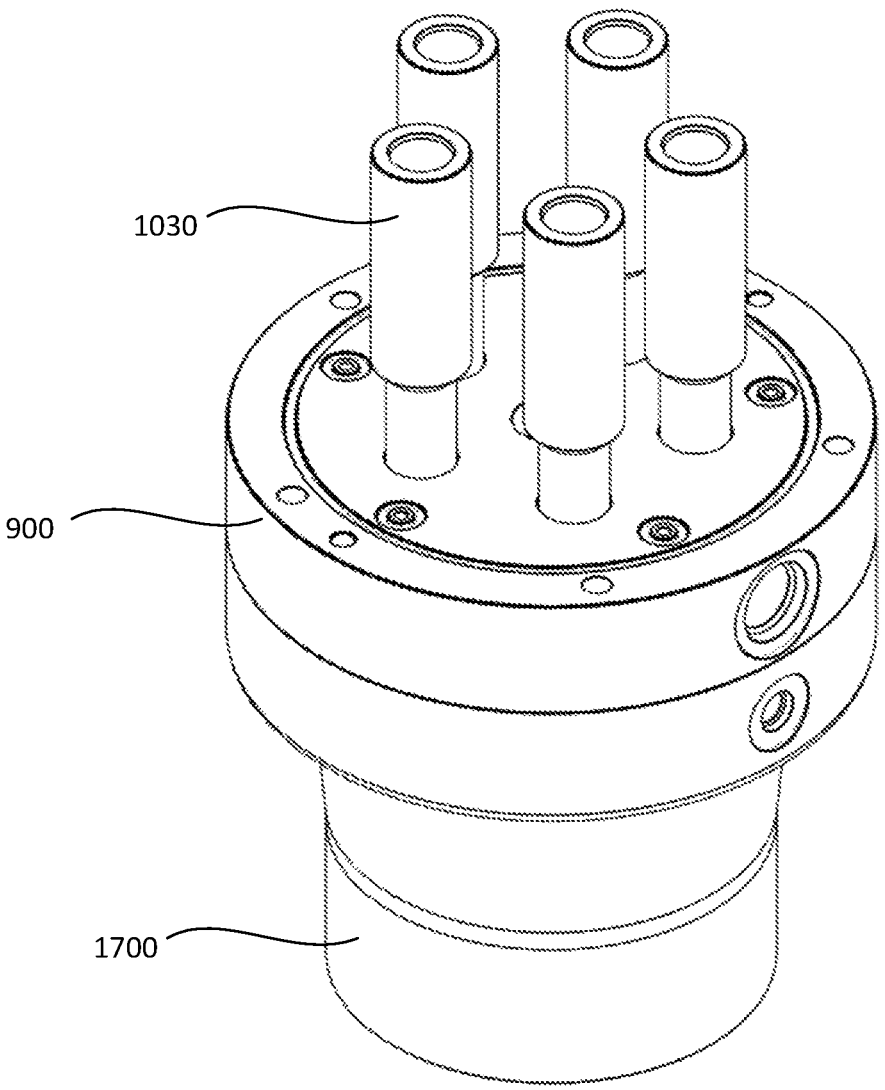
FIG. 17 shows a lower portion of the pump of FIG. 6.

At the lower end of the pump, the smaller ends of the pistons project through the piston guides 902 of the inlet plate 900 and into a volume defined between the lower end of the inlet plate and a transmission housing 1700 (FIG. 17).

Figure 18:
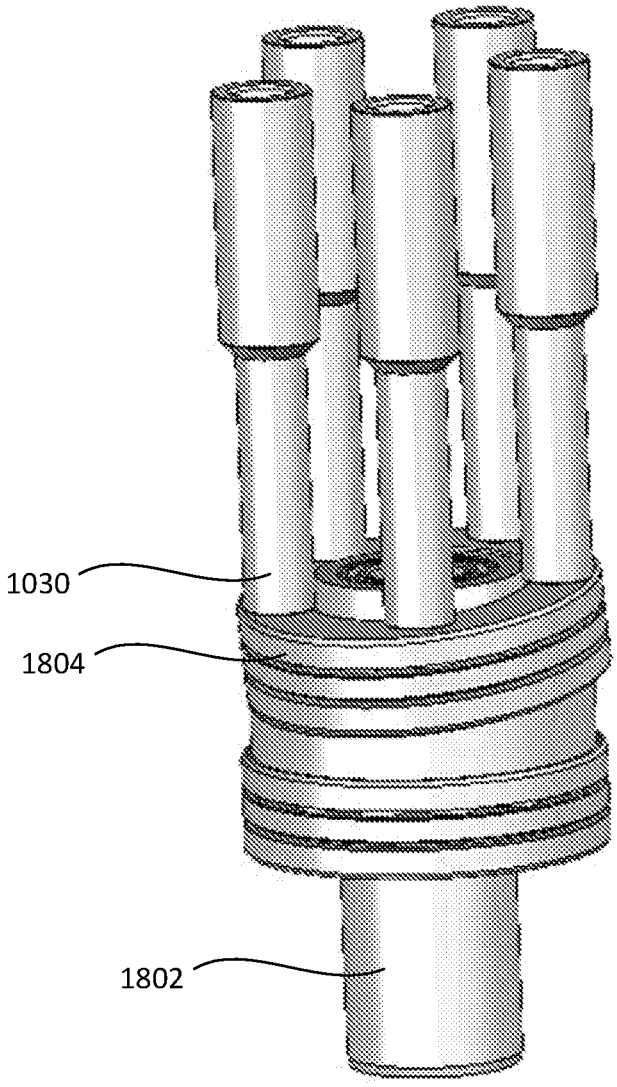
FIG. 18 shows an axle engaging the pistons of the pump of FIG. 6.

FIG. 18 shows the small ends of the pistons 1030 located on an axle 1802 and angled swash plate 1804, also known as an inclined plate or slant plate. The axle 1802 and swash plate form a piston drive that produces reciprocating motion of the pistons. As the axle 1802 rotates, the angled swash plate 1804 sequentially raises each piston, providing the intake stroke for each piston chamber. Once the high point of the swash plate is passed, the differential ambient pressure acting on the large end of the piston versus the smaller driven end of the piston, causes the piston to return, thereby executing the pressure stroke.

An end of the axle may be engaged through the transmission housing 1700 by a crank of a motor to impart rotation to the axle. Various crank motor connections will be apparent to the person skilled in the art. The motor may be a fluid filled brushless DC motor with electronic commutation. By being fluid filled, the motor is better adapted for operation at significant underwater depths. Batteries may be provided to operate the motor, as is known.

Figure 19:
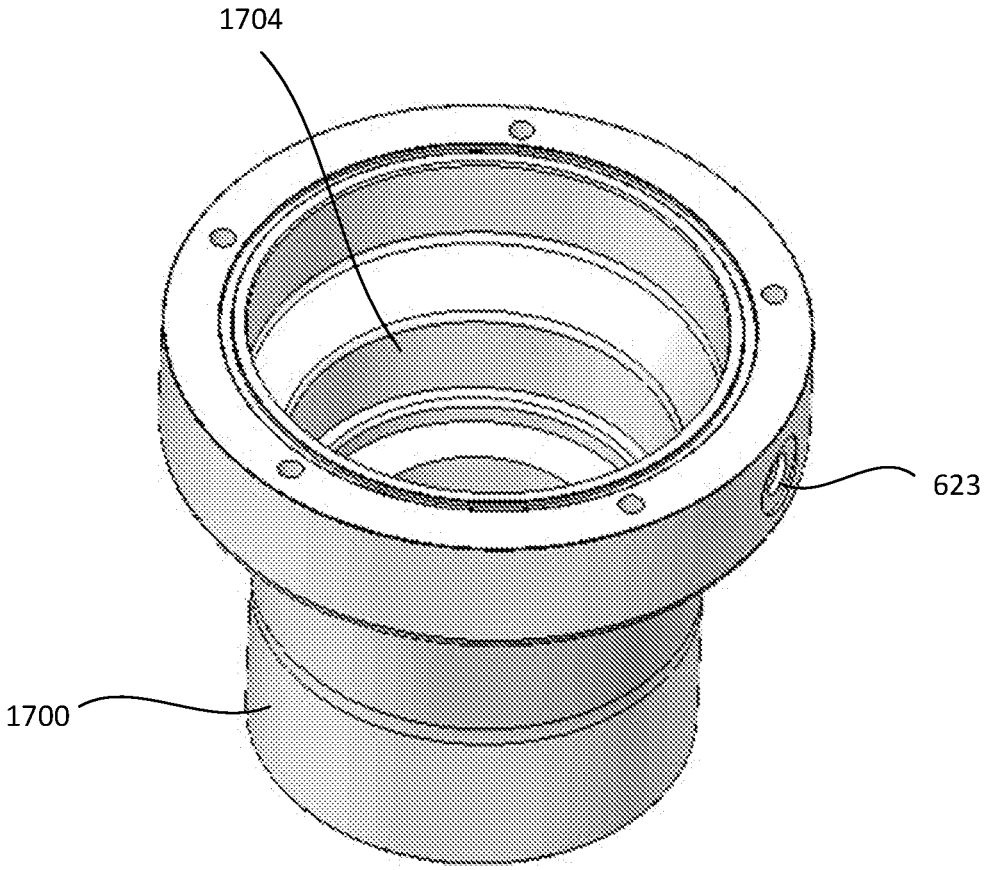
FIG. 19 shows a top view of a transmission housing.

The transmission housing 1700 is shown in isolation in FIG. 19. Internally, the transmission housing as an ambient pressure volume 1704 that is provided through inlet 623. The inlet 623 may expose the volume 1704 to ambient pressure. Alternatively, the volume 1704 may be filled with an oil that is maintained at ambient pressure.

The plates of the pump when joined together, define a continuous piston housing from the small end to the large end. The plates may be connected together using suitable bolts 630 extending through complementary and aligned holes of each of the plates. O-ring seals may be provided between the plates to prevent the egress of water into the pump body. The inlet plate 900 (FIG. 9) includes a groove 914 on the top surface for receiving the o-ring seal. Each of plates 100, 1200, 1400 as well as the transmission housing 1700 and end cap 1600 are provided with similar grooves.

Balanced operation of the pistons is provided by disposing both the large and small ends of the stepped piston in ambient pressure volumes. The figures depict two ambient pressure volumes 1604, 1704 at the large and small end of the pump respectively. The ambient pressure volumes may be maintained independently through their respective openings 627, 623. However, to ensure that each ambient pressure volume is maintained at the same pressure, the volumes may be connected through the plates of the pump. Thus, in the embodiments depicted, the transmission casing volume 1704 is connected to the end cap volume 1604 through aligned and connected holes in the inlet plate 900 (holes 950), small end plate 1000 (holes 1050), big end plate 1200 (holes 1250) and outlet plate 1400 (holes 1450). While a single connection is indicated for clarity, the figures depict multiple oil channel conduits through the plates of the pump.

Figure 20:
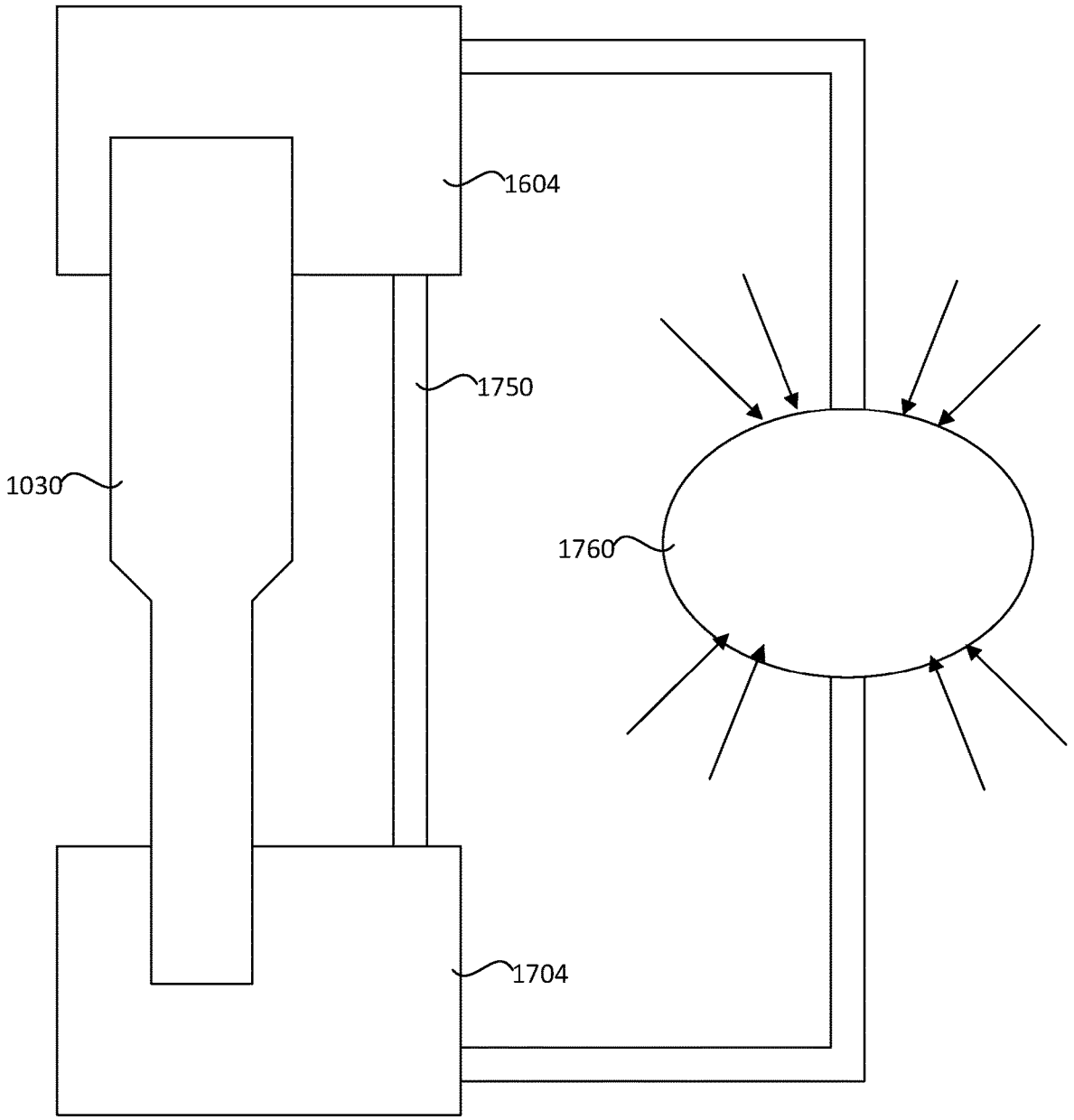
FIG. 20 schematically depicts maintaining ambient pressure within oil filled pressure volumes of the pump.

FIG. 20 schematically depicts how oil is used to maintain ambient pressure at each end of the pump. In FIG. 20, a stepped piston 1030 is depicted with its large end projecting into ambient pressure volume 1604 and its smaller end projecting into ambient pressure volume 1704. A fluid conduit 1750 connects the volumes 1604, 1704 through the pump. A flexible oil reservoir 1760 connects to the inlet 621 of the transmission volume 1704 and to the outlet 625 of the end cap volume 1604. The reservoir 1760 may be slightly pressurized, for example by a spring acting on a bladder for positive compensation. Initially, the system may be used to fill the pump with ambient fluid, such as oil. The system may be bled to remove stray air and then the connection to the reservoir 1760 may be maintained. Because the reservoir is acted on by ambient pressure, the pressure in the volumes 1604, 1704 will be at the same ambient pressure, even as the fluid compresses as the ambient pressure increases. While oil is described as the ambient pressure fluid, other fluids may be utilized including seawater in an open system and freshwater in a closed loop system.

While the embodiments, in particular the cross section of FIG. 8 show that the big ends of the piston are seated via a spring, springs at one or both ends of the piston may be considered optional.

In the embodiments depicted, the inlet poppet valve and outlet poppet valve of the same fluid path are disposed directly above each other. In an alternative embodiment, cross flow may be achieved by disposing the outlet poppet valve of one fluid path above the inlet poppet valve of an adjacent fluid path and providing an additional channel to connect the piston chamber to the outlet. Cross flow may have benefits for efficiency of operation.

The pump of the embodiments herein is described as the main pump of a two stage pumping system. However, alternative uses of the pump may be apparent to the person skilled in the art. For example, the pump may be used independently of a primary pump if sufficient inlet pressure is available.

Although embodiments of the present invention have been illustrated in the accompanied drawings and described in the foregoing description, it will be understood that the invention is not limited to the embodiments disclosed, but is capable of numerous rearrangements, modifications, and substitutions without departing from the spirit of the invention as set forth and defined by any claims that follow.

What is claimed is:

1. A pump including:

a. a pump body;

b. at least one inlet;

c. at least one outlet;

d. a fluid path between the at least one inlet and the at least one outlet;

e. at least one piston arrangement disposed in the fluid path and configured to pump fluid from the at least one inlet through the fluid path to the at least one outlet, the at least one piston arrangement including:

i. a piston chamber;

ii. an inlet valve;

iii. an outlet valve;

iv. a piston disposed to move within the piston chamber, the piston including a first outer end surface at a first end of the piston and a second outer end surface at a second end of the piston;

v. a piston drive for driving the piston within the piston chamber, the piston drive operatively attached to the first end of the piston;

f. wherein at least one of the first outer end surface and the second outer end surface of the piston are exposed to an ambient pressure; and g. wherein a surface area of the first outer end surface is smaller than a surface area of the second outer end surface such that an ambient pressure force on the second end is greater than an ambient pressure force on the first end.

2. The pump of claim 1 wherein the first outer end surface and the second outer end surface of the piston are each exposed to an ambient pressure.

3. The pump of claim 1 including least one ambient pressure chamber, wherein at least one of the first outer end surface and the second outer end surface of the piston are disposed within the ambient pressure chamber.

4. The pump of claim 3 wherein the at least one ambient pressure chamber includes a first ambient chamber at a first end of the pump and a second ambient pressure chamber at a second end of the pump.

5. The pump of claim 4 wherein the pump body includes one or more fluid conduits through the pump body that fluidly connect the first ambient chamber to the second ambient pressure chamber.

6. The pump of claim 3 the at least one ambient pressure chamber includes an inlet connection for receiving an ambient pressure fluid.

7. The pump of claim 1 wherein the inlet valve is disposed longitudinally in line with the outlet valve and wherein the piston chamber is disposed adjacent the inlet valve.

8. A pumping system for use in a subsea vessel, the pumping system including:

a. a pressure vessel;

b. a main pump disposed to pump fluid from within the pressure vessel, the main pump including:

i. a pump body;

ii. at least one inlet;

iii. at least one outlet;

iv. a fluid path between the at least one inlet and the at least one outlet;

v. at least one piston arrangement disposed in the fluid path and configured to pump fluid from the at least one inlet through the fluid path to the at least one outlet, the at least one piston arrangement including:

a piston chamber;

an inlet valve; and an outlet valve;

a piston disposed to move within the piston chamber, the piston including a first outer end surface at a first end of the piston and a second outer end surface at a second end of the piston;

a piston drive for driving the piston within the piston chamber, the piston drive operatively attached to the first end of the piston;

vi. wherein at least one of the first outer end surface and the second outer end surface of the piston are exposed to an ambient pressure; and vii. wherein a surface area of the first outer end surface is smaller than a surface area of the second outer end surface such that an ambient pressure force on the second end is greater than an ambient pressure force on the first end.

9. The pumping system of claim 8 including a motor for actuating the piston drive of the main pump to cause reciprocating motion of the piston of the at least one piston arrangement.

10. The pumping system of claim 8 wherein the first outer end surface and the second outer end surface of the piston are each exposed to an ambient pressure.

11. The pumping system of claim 8 including least one ambient pressure chamber, wherein at least one of the first outer end surface and the second outer end surface of the piston are disposed within the ambient pressure chamber.

12. The pumping system of claim 11 wherein the at least one ambient pressure chamber includes a first ambient chamber at a first end of the pump and a second ambient pressure chamber at a second end of the pump.

13. The pumping system of claim 12 wherein the pump body includes one or more fluid conduits through the pump body that fluidly connect the first ambient chamber to the second ambient pressure chamber.

14. The pumping system of claim 11 wherein the at least one ambient pressure chamber includes an inlet connection for receiving an ambient pressure fluid into the at least one ambient pressure chamber.

15. The pumping system of claim 14 including an external flexible reservoir fluidly connected to the inlet connection, the flexible reservoir containing an ambient pressure fluid, wherein the flexible reservoir is acted upon by ambient pressure.

16. The pumping system of claim 8 including a primary pump disposed to pump fluid from within the pressure vessel to the main pump.

17. A subsea vehicle including a variable buoyancy engine, the variable buoyancy engine including:

a. a pressure vessel;

b. a main pump disposed to pump fluid from within the pressure vessel, the main pump including:

i. a pump body;

ii. at least one inlet;

iii. at least one outlet;

iv. a fluid path between the at least one inlet and the at least one outlet;

v. at least one piston arrangement disposed in the fluid path and configured to pump fluid from the at least one inlet through the fluid path to the at least one outlet, the at least one piston arrangement including:

a piston chamber;

an inlet valve; and an outlet valve;

a piston disposed to move within the piston chamber, the piston including a first outer end surface at a first end of the piston and a second outer end surface at a second end of the piston;

a piston drive for driving the piston within the piston chamber, the piston drive operatively attached to the first end of the piston;

vi. wherein at least one of the first outer end surface and the second outer end surface of the piston are exposed to an ambient pressure; and vii. wherein a surface area of the first outer end surface is smaller than a surface area of the second outer end surface such that an ambient pressure force on the second end is greater than an ambient pressure force on the first end.

18. The subsea vehicle of claim 17 including a motor for actuating the piston drive of the main pump to cause reciprocating motion of the piston of the at least one piston arrangement.

19. The subsea vehicle of claim 17 wherein the first outer end surface and the second outer end surface of the piston are each exposed to an ambient pressure.

20. The subsea vehicle of claim 17 including least one ambient pressure chamber, wherein at least one of the first outer end surface and the second outer end surface of the piston are disposed within the ambient pressure chamber.

21. The subsea vehicle of claim 20 wherein the at least one ambient pressure chamber includes a first ambient chamber at a first end of the pump and a second ambient pressure chamber at a second end of the pump.

22. The subsea vehicle of claim 21 wherein the pump body includes one or more fluid conduits through the pump body that fluidly connect the first ambient chamber to the second ambient pressure chamber.

23. The subsea vehicle of claim 20 wherein the at least one ambient pressure chamber includes an inlet connection for receiving an ambient pressure fluid into the at least one ambient pressure chamber.

24. The subsea vehicle of claim 23 including an external flexible reservoir fluidly connected to the inlet connection, the flexible reservoir containing an ambient pressure fluid, wherein the flexible reservoir is acted upon by ambient pressure.

25. The subsea vehicle of claim 17 including a primary pump disposed to pump fluid from within the pressure vessel to the main pump.

* * * * *